United States Patent [19]

Schwarz

[11] 4,129,086

[45] Dec. 12, 1978

[54] METHOD AND MEANS FOR THE ACOUSTICAL STEERING OF SUBMARINE TORPEDOES

[76] Inventor: Hans-Dieter Schwarz, Am Querkamp 58, 28 Bremen, Fed. Rep. of Germany

[21] Appl. No.: 689,748

[22] Filed: Dec. 4, 1967

[30] Foreign Application Priority Data

Dec. 24, 1966 [DE] Fed. Rep. of Germany ..... 9046565

[51] Int. Cl.[2] ..... F42B 19/01; F42B 19/10; G05D 1/00

[52] U.S. Cl. ..... 114/23; 114/20 R

[58] Field of Search ..... 114/20, 21, 23

[56] References Cited

U.S. PATENT DOCUMENTS

| | | | |
|---|---|---|---|
| 1,588,932 | 6/1926 | Blair | 114/21 |
| 3,005,434 | 10/1961 | Bennett | 114/23 |
| 3,045,624 | 7/1962 | Daly et al. | 114/20 |
| 3,332,382 | 7/1967 | Finlon et al. | 114/20 |

*Primary Examiner*—Samuel W. Engle
*Assistant Examiner*—Thomas H. Webb
*Attorney, Agent, or Firm*—Wolf, Greenfield & Sacks

[57] ABSTRACT

A torpedo has an acoustical system for detecting targets and directing the torpedo toward the target. An electric motor drives a cam that operates a switching arrangement that alternately changes the torpedo motor speed between fast and slow speeds. Upon sensing a target, the voltage applied to the motor driving the cam is increased to speed up the switching cycle and thereby shorten the duration of the slow and high speed intervals.

14 Claims, 6 Drawing Figures

METHOD AND MEANS FOR THE ACOUSTICAL STEERING OF SUBMARINE TORPEDOES

Figure 1:
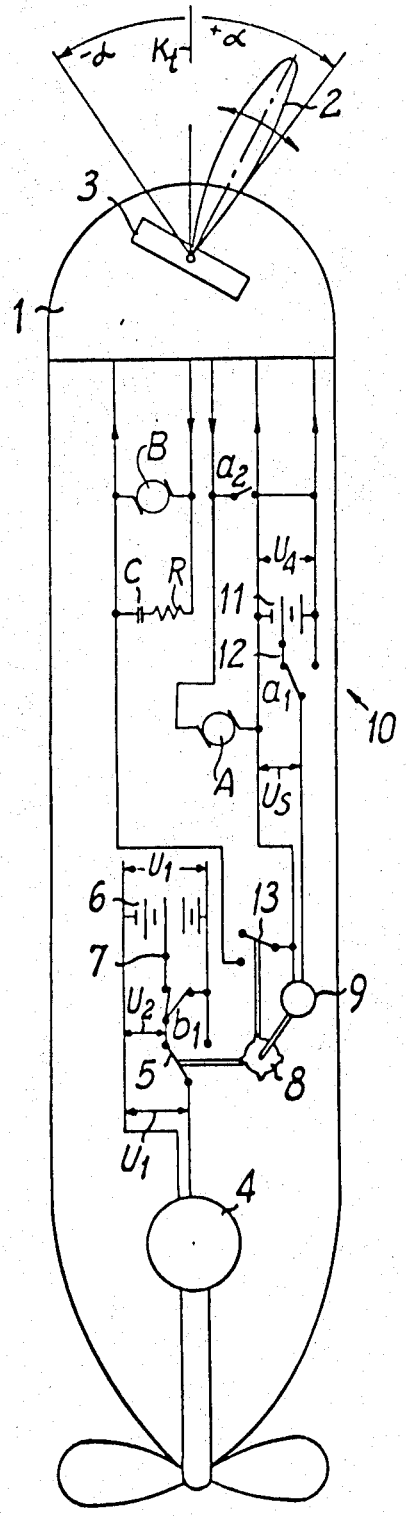

This invention relates generally to a method for steering a torpedo, according to which the bearing of the target is taken acoustically by a direction finder and the run of the torpedo is corrected according to the position values obtained by said acoustical bearing of the target.

It is known that at the acoustical steering of torpedoes the range within which bearing of a target can be made depends considerably on the speed of run of the torpedo. I.e. in torpedoes with acoustically controlled self-steering the range of passive target detection decreases by about half the value when the speed of the torpedo increases by about 4 kn, provided that the noise level of the propeller of the target remains constant. Fast running torpedoes for passive target detection only have a sufficient range of detection when used against fast running targets, thereby producing a noise of a correspondingly high level, whereas the range of detection with slow running targets is absolutely insufficient. When using active direction finders, the range of detection can only be brought to useful value by applying an extremely high energy of transmission.

However, there is a necessity to adapt the speed of a torpedo to the maximum speed of the target so that the latter cannot evade the torpedo. The ratio of the speed of the target to that of the torpedo becomes still more unfavourable when the electro-acoustic transducer is installed in the head of the torpedo, and if it has a small directional characteristic, as in this case the torpedo has, for searching a sector in front of the torpedo, to steer on a serpentine-like course resulting in a decrease of the speed of the approach towards the target.

With known procedures of acoustical target control it is necessary to make a compromise between the contradictory requirements for the high speed and large pick-up range. Therefore it was necessary to depart from the otherwise obtainable optimal speed of the torpedo and the optimal large pick-up range. This disadvantage becomes more important when the torpedo has to run a serpentine-like course for the detection of a target.

The object of the present invention is to provide a method and means adapted to obtain, without considerable disadvantages, an optimum pick-up range and simultaneously a torpedo speed sufficient to detect and hit the target with the greatest probability.

This task is solved in a simple manner in that the speed of the torpedo is reduced from time to time during the run of the torpedo, and that the direction values obtained by acoustical bearing determinations during said periods of reduced speed are used for correction of steering. It can be proved that it is possible to obtain an optimum range of detection without the disadvantage of an important decrease of the effective torpedo speed. It will be even possible to increase the mean torpedo speed by adjusting to any bearing when the torpedo proceeds with a high speed, so that a compromise with acoustical conditions is no longer necessary during such high speed intervals. It is possible to accelerate or to delay within a few seconds the speed of the torpedo on a minimum and maximum speed or vice-versa, so that the intervals of reduced torpedo speed may be very small. The length of intervals for the reduced speed is determined by the time necessary for the dying down of the noise level of the torpedo and by the time necessary for picking up and storing of the signals from the target. An especially rapid detection of the target is possible if the angular section in the front of the torpedo, in which a target may be located, is controlled by a receiver array with overlapping directional characteristics. However, the method according to the invention may also be applied if the angular section in front of the torpedo is controlled by scanning a small search sector.

It is recommended before a target is picked up to use rather long high speeds and reduced speed intervals and to change over to shorter time intervals when a target has been picked up. The decrease of the length of reduced speed intervals is preferably applied in dependance on the increase of the signal-to-noise ratio. For the same purpose the extent of speed decrease may be reduced in dependance on the increase of the signal level of the target. This may be performed in a very simple manner by changing over to high speed after having picked up the target. The reduction of the length of reduced speed intervals may be utilized for reducing the period between successive reduced speed intervals in dependance on the signal-to-noise ratio.

Figure 2:
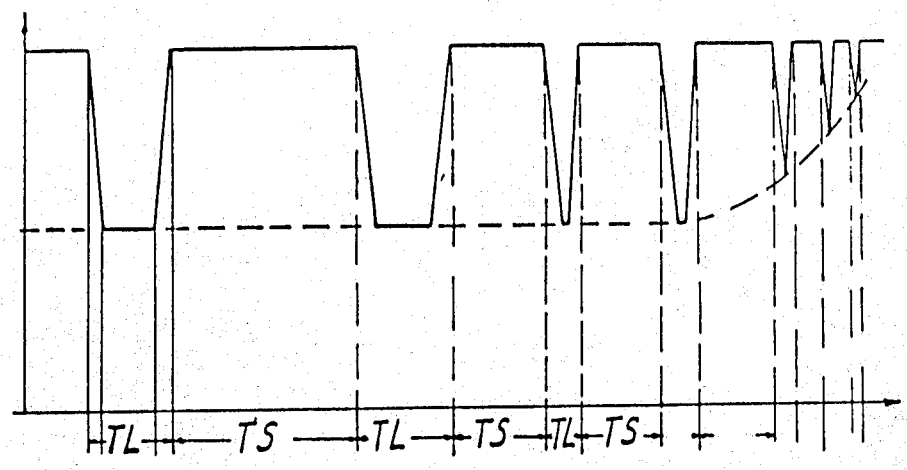
Figure 3:
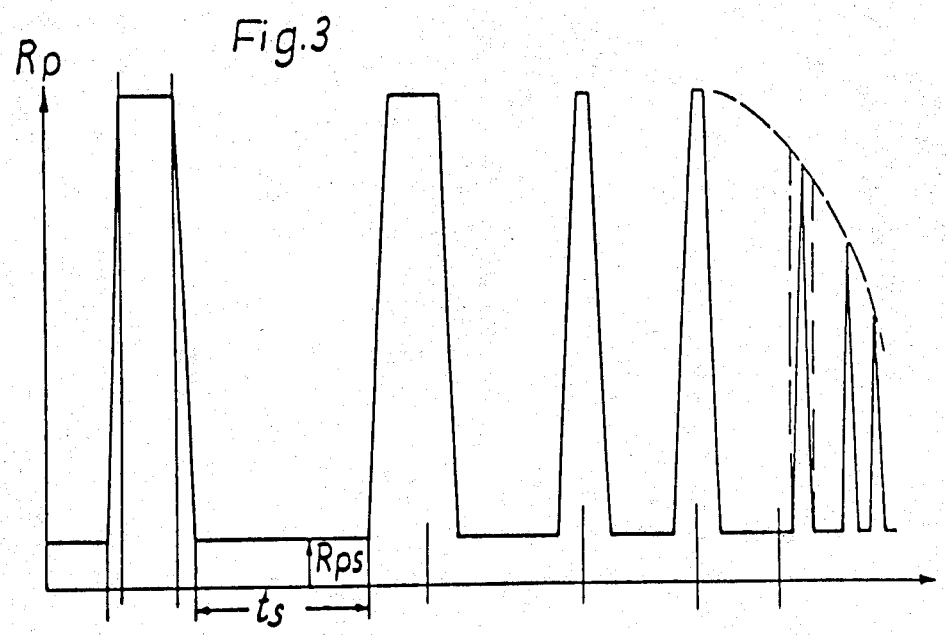
Figure 4:
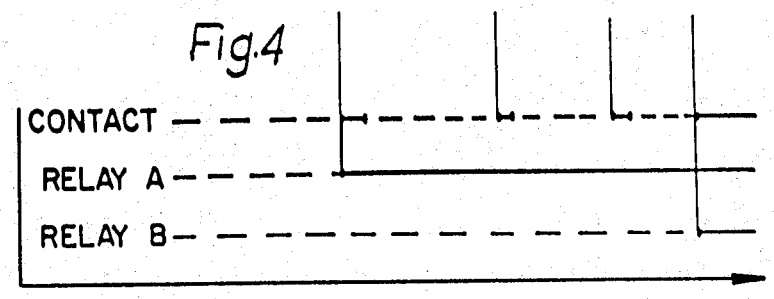
Figure 5:
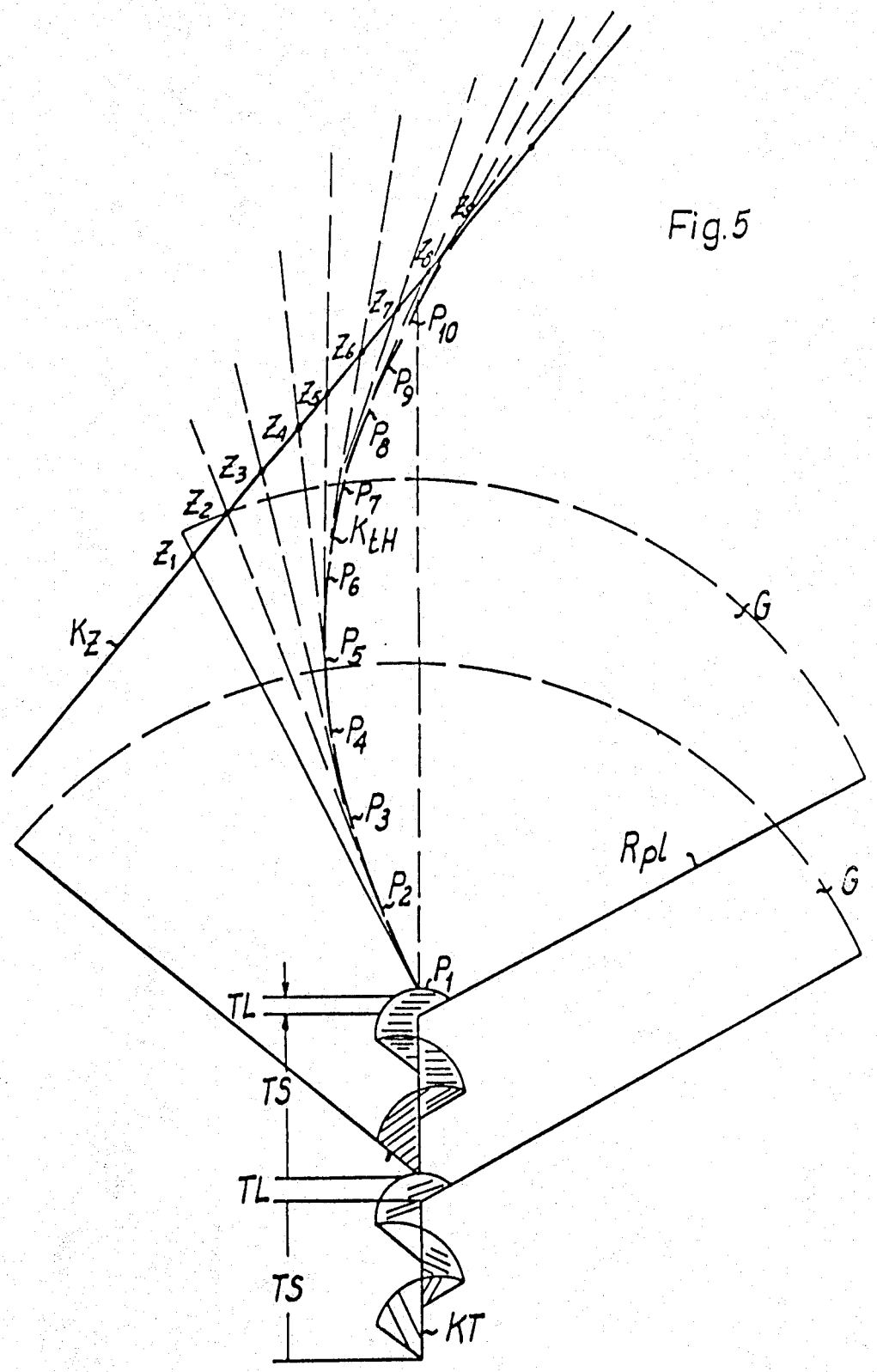
Figure 6:
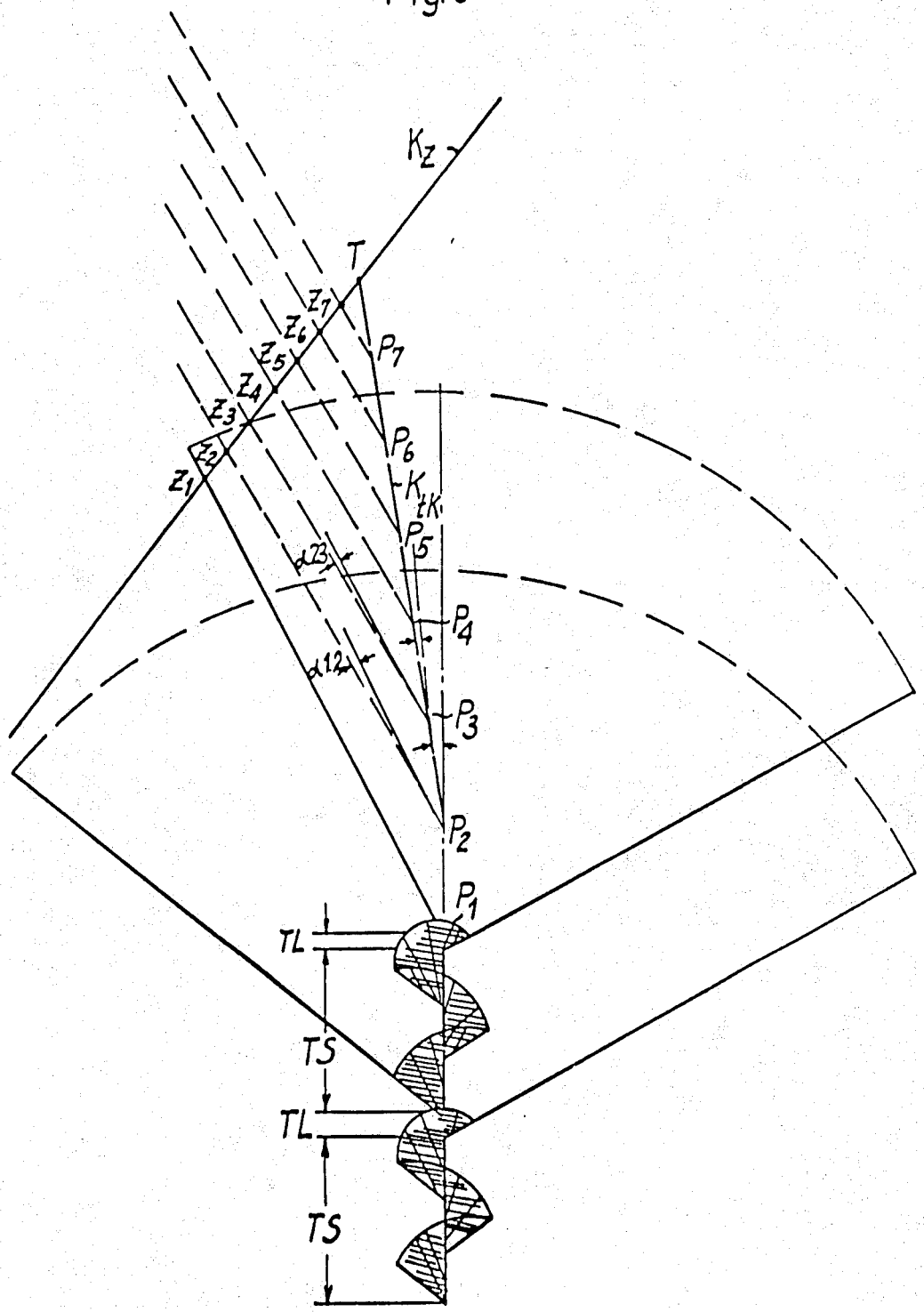

This invention becomes better understood by reference to the following detailed description when considered in connection with the accompanying drawings, in which:

FIG. 1 is a block diagram of the device according to the invention in a torpedo, FIG. 2 is a diagram showing the speed curve of the torpedo according to FIG. 1, FIG. 3 is a diagram showing the range of detection in accordance with a speed curve according to FIG. 2, FIG. 4 is a relay contact diagram for the device according to FIG. 1, in accordance with the diagrams for the speed curve and the range of detection according to FIGS. 2 and 3, the blocks in FIGS. 2-4 being to a common time scale, FIG. 5 is a path- and detection diagram, related to FIGS. 2-4 for a torpedo according to FIG. 1 by applying a control of the torpedo according to the dog curve procedure; and FIG. 6 is a corresponding path- and-detection diagram for a torpedo with control in accordance with the known procedure of proportional navigation.

The torpedo as presented in the drawing is provided with means for acoustically controlled steering by which the target, for instance a ship to be attacked, is acoustically picked up by a direction finder in the torpedo and by which the course of the torpedo is corrected in dependance on the measuring values indicated by the direction finder.

Such a device for acoustical steering control is known in the art and is not the object of the present invention. This device can be of any type of construction and operates according to different procedures. This device is generally arranged in the head part 1 of the torpedo, and its essential part is an acoustical direction receiving arrangement 3 which determines from the acoustical information received from an angular range of $\pm\alpha$ of i.e. $\pm 60°$ the direction of the target with the zone or sector enclosed by the angle with an accuracy of approximately $\pm 2°$. This information is used in the applied procedure to correct the course $K_t$ of the torpedo. This correction is made with a steering method by which the pursuit of the target is made according to the so-called dog leg curve. The deviations between the bearing and the ahead-direction are nullified by automatic correction of $K_t$. Automatic acoustical steering control is accomplished according to proportional navigation procedures the difference between any two previous bearings is used for effecting a proportional changes in the direction of the course. In the first case the course of the torpedo is so corrected by the acoustical automatic control, that the target remains as exact as possible in the ahead direction K, whereas in the second case the target remains, as exact as possible, in a predetermined angle to the ahead-direction K. Besides these known methods of acoustical control steering there are still other methods. These methods can also be applied to the invention which will be described hereafter.

The embodiment of the invention shows a device for acoustically controlled self-steering of a torpedo, in which the angular range $\pm\alpha$ in front of the torpedo is controlled by scanning of a small search sector 2. Scanning of said search sector can be made, as is shown in the drawing, by scanning of a corresponding directional receiver 3 or according to the known method by electrical compensation in connection with a receiver array. The known torpedoes have controls which after a certain time after launching can be pre-adjusted with some types of torpedoes according to different points of view. Contrary to this the torpedo according to the invention is provided with means, by which the speed is reduced from time to time temporarily. In the example this is performed by changing the operational voltage $U_1$ for the drive motor 4 of the torpedo. For this purpose a change over switch 5 is provided, which connects the motor 4 alternatly to the total voltage $U_1$ or to the voltage source 6 or to a tap 7 of the voltage source with the partial voltage $U_2$. The periods for the connection of $U_1$ and $U_2$ respectively are determined by a cam disk 8 which is driven by a motor 9.

The sequence of the change over between $U_1$ and $U_2$ is determined by the speed of the motor 9 and the speed of the motor can likewise be changed by means of a switch 10, by which the motor 9 is connected to the total voltage $U_4$ of the voltage source 11 or to a tap 12 of this voltage source with the partial voltage $U_5$.

Changing of the motor voltage from the smaller voltage $U_5$ to the higher voltage $U_4$ is made at the response of a relay A by its contact $a_1$. This relay A is energized as soon as the receiving device in the torpedo head 1 is supplied with information about the existence of a target within the range of control. After a target has been picked up, a holding contact $a_2$ keeps the change contact $a_1$ of the A-relay in its change over position, so that the motor 9 after pick-up of the target continues to operate with a higher speed, so that the sequence for the change of speed of the torpedo becomes faster so that it, i.e., becomes twice the rate before the target had been picked up. As may be seen from the diagram in FIG. 2 this increases the frequency of the change over operation and it decreases simultaneously the change over period. The high speed periods TS as well as the periods TL of reduced speed become shorter.

When a target is picked up, a relay B is excited with a certain time delay which is determined by a charging circuit including a capacitor C and a charging resistance R, which is connected in parallel to the relay. When this relay responds, it is changed by a relay contact $b_1$ of the relay B from the smaller voltage $U_2$ to the higher voltage $U_1$ before this change over would be made by the cam disk 8 whenever the target is picked up at a reduced torpedo speed so early that, by considering the delay in response by the charging circuit C-R the relay B responds before the time when the cam disk 8 would effect the change to high speed. This has for result that the time intervals TL of the reduced speed are reduced with increasing signal-to-noise ratio. If the change over of the relay B is actuated before the speed of the torpedo has decreased after change over to the lower voltage $U_2$ has decreased to the equilibrium value VL, the extent of the decrease of the speed is diminished with increasing target level as may be seen from the speed curve in FIG. 2.

The cam disk 8 actuates synchronizing contact 13 which at the beginning of any time interval TL of reduced speed a synchronizing pulse is transmitted to the direction finder effecting that the search characteristic 2 takes at the beginning of each time interval TL one of the two limit positions, and the searching of the total range $\pm\alpha$ starts from this limit position. This prevents unnecessarily high searching periods for the scanning of the total range at the reduced speed. The operation of the device is explained in a more detailed manner in connection with the diagrams according to FIG. 2–6.

The maximum range of detection of an acoustic direction finder can only be obtained at the minimum noise level of the torpedo, thus at the torpedo speed at which the noise level corresponds to that of the surrounding noises produced by the motion of the sea. This optimum speed depends considerably on the type of torpedo and on the depth of the path of the torpedo in the water. This optimum speed will be about 9 m/sec.

To increase of the speed by 1,5 m/sec. corresponds to an increase of the noise level by twice the value. The torpedo with a higher speed of 6 m/sec with a speed V of approximately 30 kn has consequently a noise level which is higher by 8 times. Considering the damping of sound waves in water in dependance on the frequency of detection only one eighth of the passive range of detection is usable. Also with higher frequencies of sound waves, which are used with torpedoes because of the reduced dimensions of the sound transducers, higher ranges of detection will not be fully reached, however, there is nevertheless the fact that the passive range of detection of fast torpedoes may be increased by several times by a temporary decrease of the torpedo speed. This increase of the range of detection RP is represented in FIG. 3 as a function of time in correspondence to the diagram of the torpedo speed according to FIG. 2. During the fast speed period PS the range of detection $R_{ps}$ has a minimum value, and it increases during the slow periods to the value $R_{pl}$, which is approximately 8 times the value $R_{ps}$. As long as the target has not been acoustically picked up as the target level is inferior to the noise level caused by the motion of the sea or inferior to the noise level of the torpedo at the speed VL, the sequence of the change over from a faster torpedo speed VS to the smaller speed VL, and simultaneously the length of the fast period TS and the slow period TL are determined by the speed of rotation of the cam disk 8 which corresponds to the smaller speed of the motor 9 at motor voltage $U_5$. FIG. 5 and 6 represent the path of the torpedo and in dependance thereon the range of the detection sector of the direction finder.

For safe detection of all targets the complete range of detection which is determined at the slow running by the great range of detection $R_{pl}$ the high speed periods must not be made too long. The period of the high speed run of the torpedo is determined by the estimated passive minimum range of detection $R_{pl}$ at the slow running of the torpedo or at search run. This period is diminished by the time of reaction of the torpedo. Supposing that this period is 900 m and that the speed of the torpedo is 20 m/sec the torpedo may have alternatively a high speed over 45 sec and low speed over 15 sec.

The period TL for the low speed is determined by the maximum time until the target is picked up and the target information is stored. This time with scanning the receiver array may be 10 sec. Moreover a period for the dying down of the noise level of the torpedo may be 10 sec. At the speed of 9 m/sec during the time TL and a speed of 20 m/sec during the period TS there will be in the described phase of the run of the torpedo with the ratio TS/TL = 3 a mean speed of torpedo of $(9 + 3 \cdot 20)4 = 17{,}2$ m/sec of 86% of the maximum speed. This result is still considerably improved by using means for relative reduction of the slow speed periods TL after detection of the target.

As may be seen from FIGS. 5 and 6, during the fast speed period of 45 sec the whole angular range is scanned three times however only with the small range of detection $R_{pt}$. Then during the slow speed period TL the angular range is scanned once with a range of $R_{pl}$ approximately 10 times greater. The controlled sectors T in consecutive reduced speed intervals TL overlap one another, and there will be only relatively small boarder areas $G_r$ in which existing targets are no longer detected.

The vessel against which the torpedo has been launched may be on the course $K_z$ and may be at the point $Z_1$ at the moment when the torpedo on its straight course $K_t$ has reached the point $P_1$. It can be seen that the range of detection at the fast speed of the torpedo does not yet permit a detection of the target whereas at the preceding low speed period the target is lying already nearby the controlled sector G with its large range $R_{pl}$ and is included in the next following sector G from point $P_1$.

As soon as the target has been detected, scanning of the angular range by the receiving device is discontinued. The receiving device is stopped in the determined direction $P_1$-$Z_1$, whereas simultaneously the course of the torpedo $K_t$ is corrected to this direction $P_1$-$Z_1$. At the same time the sequence of change over from high speed to slow speed is accelerated as already described above as motor 9 changes to high speed operation, to reduce the period of a cycle formed by the intervals TS and TL for fast and slow speed operation, respectively (see FIG. 2). The slow speed periods follow one another so quickly that departure of the target from the direction characteristic 2 of the receiving device is not possible. At each following slow speed operation the target is detected again and its deviation from the previous measured direction $P_1$-$Z_1$ corresponding to the angle between the two directions $P_1$-$Z_1$ and $P_2$-$Z_2$ is measured, and the course of the torpedo is continuously adjusted to the new direction $P_n$-$Z_n$ towards the target, in the present case to the direction $P_2$-$Z_2$. The torpedo pursues the target in this mannr on a so-called dog curve $K_{tH}$.

During further approach travel of the torpedo toward to the target the slow speed periods are reduced as described above by an earlier response of the acoustic receiving device until finally the torpedo has approached so close to the target that the target is already within the small range of detection $R_{pt}'$ at fast speed operation. Then a change over to slow speed operation is not made any more, but the torpedo proceeds at its maximum speed on the dog curve until it reaches the target.

In FIG. 6 for the sake of comprehension the path of the torpedo is shown with an automatic steering control according to proportional navigation. After the first pick-up of the target at point $P_1$ the target direction $P_1$-$Z_1$ is stored, but contrary to the dog leg curve method the course of the torpedo is not changed at first. At the next slow speed period the target direction $P_2$-$Z_2$ is measured and compared compared with the stored target direction $P_1$-$Z_1$, and the course of the torpedo is corrected by an angle $\alpha_{1,2}$ which is proportional to the difference angle between $P_1$-$Z_1$ and $P_2$-$Z_2$. After the course has been corrected several times by angles $\alpha_{2,3} \ldots \alpha_{n,n+1}$, the torpedo will have the correct course; namely, if $\alpha = 0$. A deviation found during any following measurement, if any, is then used in the same manner for the correction of the course of the torpedo. By applying this method of proportional navigation the torpedo proceeds to the target on the so-called collision course $K_{tK}$. The apparatus requirements for this steering are only little higher than those required for the dog leg curve method. The proportional navigation has the advantage that the curve of the torpedo path becomes shorter than with the dog leg curve method, so that torpedo attacks against faster targets are possible, moreover, reducing the possibilities of the target to evade.

Moreover when applying this method a quicker approach to the target and decrease of time to slow speed periods and thus a greater average speed of the torpedo is obtained. With change over to the faster sequence from fast speed operation to slow speed operation after a target has been picked up results automatically in an increase of the security against a loss of the target. When the torpedo approaches the target and when the target is some hundred meters in front of the torpedo, the target may be continuously detected at the high torpedo speed and thus its position may be continuously monitored.

The foregoing disclosure and the showings made in the drawings are merely illustrative of the principles of this invention as embodied in a particular torpedo and are not to be interpreted in a limiting sense. The invention may therefore not only be applied to torpedoes with an acoustical controlled self-steering device but it may be applied with an enhanced probability of hitting with torpedoes which are steered from an acoustical locating station. With this method the torpedo flight path is maintained by remote control, from the acoustic location station in a straight line between the location station and the target. It is obvious that receiving of noises from the target is considerably interfered with by the noise level of the torpedo so that by a temporary reduction of the speed of the torpedo the target may be located at the locating station and also in the torpedo. When the angular sector in the front of the torpedo or the angular sector in the direction of the target is controlled by a receiver array with several directional pattern characteristics overlapping one another, the slow speed periods required for picking up and for storing the information from the target will be considerably reduced. Also in this case the direction of the target is found by a scanning of the angular section, however, this scanning may be made so rapidly that the time loss is unimportant and may be i.e. only 0,5 sec. In such target location equipment it is therefore not necessary to stop scanning of the angular section after the target has been picked up.

Depending on the method of steering control employed merely a storing of the bearing values may be desirable.

The above mentioned examples relate to passive location methods in which only the acoustical noise level of the targets (i.e. noise of the propeller) are utilized for the determination of the direction and possibly of the distance of the target. The invention may be used in the same manner with active sonar methods by which the echoes from the target are used for determination of direction and range to the target according to the acoustic sound reflection method.

In order to maintain the contact with the target continuously during the last part of the path of travel, even if the range of detection at the fast speed does not yet permit this, the speed of the torpedo may, when the torpedo has approached to a certain distance to the target and/or if a certain nose level of the target has been exceeded, be gradually increased so that contact with the target is continuously maintained.

In the control of the torpedo by remote steering, either by acoustical location from a locating station, or by an acoustical location from the torpedo, and the transmission of the target information to the observation station by radio or wire (telephony), the time program for the torpedo speed may be arbitrarily determined by hand or by a computer by remote control.

What is claimed is:

1. A method of steering a submarine torpedo towards a target in which the bearing of the target from the torpedo is determined acoustically and the steering connected according to the relative position of the target with respect to the torpedo and the target position thus determined which method includes the steps of, raising and lowering the speed of said torpedo during alternating mutually exclusive high and low speed intervals respectively, measuring the distance between said torpedo and a target during each slow speed interval, shortening the duration of said slow speed intervals in response to sensing a target, and correcting the steering of said torpedo in response to the distance measurements, thereby to move said torpedo along a collision course with said target.

2. A method in accordance with claim 1 wherein said measuring step includes providing a signal characterized by a signal-to-noise ratio and the slow speed intervals are reduced in duration with increasing signal-to-noise ratio in measuring the distance between said torpedo and said target.

3. A method in accordance with claim 1 wherein said measuring step includes providing a signal characterized by a signal-to-noise ratio and the extent of the reduction of speed during said slow speed intervals is decreased with increasing signal-to-signal noise ratio in measuring the distance between said torpedo and said target.

4. A method in accordance with claim 1 wherein immediately upon receiving an acoustical signal from said target said torpedo is changed over to high speed propulsion.

5. A method in accordance with claim 1 wherein said measuring step includes providing a signal characterized by a signal-to-noise ratio and the time interval between consecutive reductions of speed of said torpedo is reduced with increasing signal-to-noise ratio of measuring the relative position between said torpedo and said target.

6. A method in accordance with claim 1 and further including the step of gradually increasing said slow speed as said torpedo approaches said target while continuously receiving acoustical signals from said target during said slow speed time intervals.

7. A method in accordance with claim 1 and further including the step of correcting the steering of the torpedo to follow a dog leg curve.

8. A method in accordance with claim 1 wherein said measuring step includes measuring the difference between the bearings between said torpedo and said target obtained in any of the most current two slow speed intervals to provide a difference signal, and processing said difference signal in accordance with proportional navigation to correct the course of said torpedo toward said target.

9. A method in accordance with claim 1 wherein said measuring step includes making such measurements from an acoustical station remote from said torpedo and said target and maintaining the course of said torpedo on a straight line between said acoustical station and said target.

10. Apparatus for steering a torpedo toward a target comprising, said torpedo, acoustic direction finding means for providing a signal representative of the distance between said torpedo and said target, course correcting means for correcting said course, switching means for alternately establishing slow speed time intervals and high speed time intervals during mutually exclusive alternating contiguous time intervals when said torpedo travels at slow and high speeds respectively, means responsive to sensing a target for shortening the duration of said slow speed intervals, and means for correcting the steering of said torpedo in response to said signal representative of the distance between said torpedo and said target for moving said torpedo along a collision course with said target.

11. Apparatus in accordance with claim 10 and further comprising means for altering the switching rate of said switching means according to a predetermined time schedule.

12. Apparatus in accordance with claim 11 and further comprising means responsive to a signal from said acoustical direction finding means for altering said rate.

13. Apparatus in accordance with claim 12 wherein means for altering said rate includes means for permanently increasing said rate in response to said acoustical direction finding means sensing a target.

14. Apparatus in accordance with claim 11 and further comprising, means responsive to the reception of each signal from said target by said acoustic direction finding means for immediately establishing said high speed time intervals.

* * * * *